US005626124A

United States Patent [19]

Chen

[11] Patent Number: 5,626,124

[45] Date of Patent: May 6, 1997

[54] CUTTER FOR TRIMMING TILES

[76] Inventor: Wen-Chih Chen, Suite 2, 7F, No. 95-8 Chang Ping Road, Sec. 1, Taichung, Taiwan

[21] Appl. No.: 643,383

[22] Filed: May 6, 1996

[51] Int. Cl.[6] ..... B28D 1/32

[52] U.S. Cl. ..... 125/23.02; 125/23.01

[58] Field of Search ..... 225/96.5, 96; 125/23.02, 125/23.01; 83/886, 466, 468, 565, 879, 882, 62

[56] References Cited

U.S. PATENT DOCUMENTS

| | | | |
|---|---|---|---|
| 1,661,897 | 3/1928 | Koehler | 125/23.02 |
| 1,994,420 | 3/1935 | Persson | 125/23.02 |
| 1,995,741 | 3/1935 | Granite | 125/23.02 |
| 2,272,160 | 2/1942 | Driver | 125/23.02 |
| 2,541,708 | 2/1951 | Marus | 125/23.02 |
| 2,568,816 | 9/1951 | Marus | 125/23.02 |
| 4,939,968 | 7/1990 | Stoof | 83/886 |
| 5,040,445 | 8/1991 | Lion | 125/23.02 |
| 5,040,521 | 8/1991 | Pourtau et al. | 125/23.02 |
| 5,169,045 | 12/1992 | Liu | 125/23.02 |
| 5,293,801 | 3/1994 | Dritenbas | 83/468.4 |
| 5,303,690 | 4/1994 | Ishii | 125/23.02 |
| 5,560,274 | 10/1996 | Turner | 125/23.02 |

FOREIGN PATENT DOCUMENTS

| | | | |
|---|---|---|---|
| 318466 | 1/1920 | Germany | 125/23.02 |
| 2814835 | 10/1979 | Germany | 125/23.02 |
| 2855649 | 7/1990 | Germany | 125/23.02 |
| 550729 | 5/1958 | Italy | 125/23.02 |
| 357327 | 11/1961 | Switzerland | 125/23.02 |

*Primary Examiner*—James G. Smith
*Assistant Examiner*—Derris Banks

[57] ABSTRACT

A cutter for trimming tiles comprises generally a flat rectangular base, a first trapezoidal seat pivoted to one end of the base, a second trapezoidal seat sliding about an arcuate rail perpendicular to the other end of the base, a pair rail rods extended parallel to the axis of the base and secured at their two ends into the first and second trapezoidal seats respectively so that the rail rods can laterally swing about the arcuate therewithin. A cutting tool slides about the rail rod thereon having a cylinder shaft attached with a handle and a blade rotatably secured to the center of the cutting tool. So that cutter of the present invention can trim a straight line, a beveled straight line, a curve or a circle in a tile.

4 Claims, 11 Drawing Sheets

CUTTER FOR TRIMMING TILES

BACKGROUND OF THE INVENTION

The present invention relates to cutting tools and more particularly to a structully improved cutter for trimming tiles which cutter can cut the tiles into various angular or arched form and/or a regular circle.

Prior art tile cutter (as shown in FIG. 1) has a rectangular base 1, a pair of rail rods 2 parallel secured to a pair of retaining seat 3 and 4 above the base 1 and a cutting tool 5 sliding about the rail rod longitudinally so as to cut straight lines in a tile. Nevertheless, this cutter has incorporated with transversely sliding device and scale means to precisely locat the horizontal positions and to cope with the different size of the tiles, it only performs straight cuttings.

In the architectural filed, the design of buildings trends to artistic and versatile, many vivid patterns on a building have to be worked out by colorful tiles. To precisely trim the tile in order to cope with the different curves or angles of the patterns or to match with a circular object such as a drain trap is very important. Currently, the plasterer uses this cutter to trim tangent lines to make a polygon instead of a circular in a tile as shown in FIG. 2, but it does not conforable with the substantial situation.

SUMMARY OF THE PRESENT INVENTION

The present invention has a main object to provide a cutter for trimming tiles which cutter can trim a straight or an angled straight line or an arched line or a regular circle in a tile.

Accordingly, the cutter of the present invention comprises a rectangular base, a pair of rail rods prependicularly secured at their two ends into a pair of a first and a second seat members. The second seat member which slides about an arcuate rail secured at one end of the base so as to permit the rail rod horizontally sliding therein upon an axis pin at the other end of the base and a cutting tool slidingly sleeved on the rail rods including a circular trimming device therein. So that the cutter of the present invention can trim in the tile a straight line, an angled straight line, an arcuate line or a regular circle.

The present invention will become more fully understood by reference to the following detailed description thereof when read in conjunction with the attached drawings.

DETAILED DESCRIPTION OF THE PREFERRED EMBODIMENT

Figure 3:
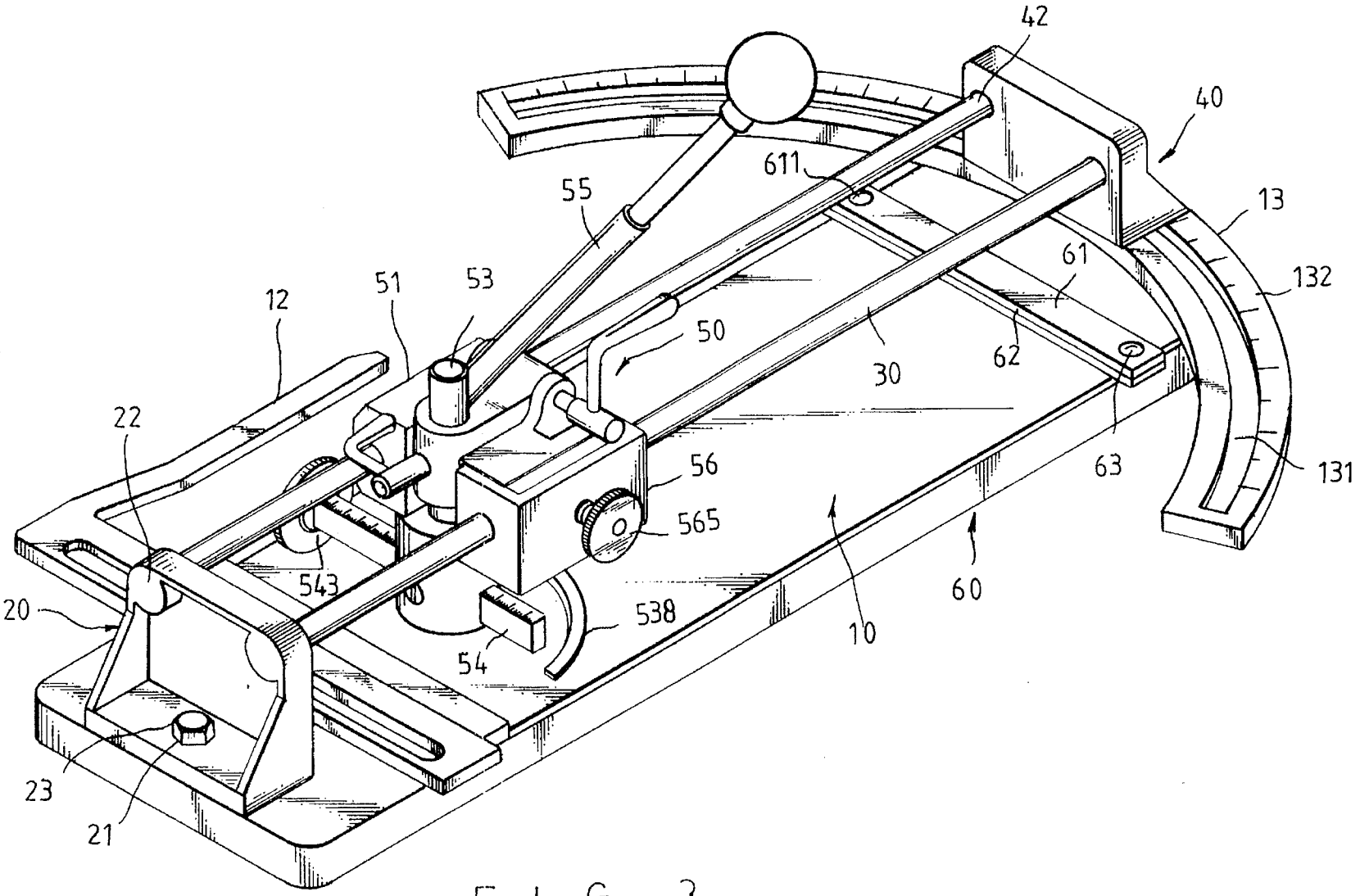
FIG. 3 is a perspective view to show a preferred embodiment of the present invention.

With reference to FIG. 3 of the drawings, the cutter for trimming tiles of the present invention comprises a flat rectangular base 10, a first trapezoidal seat member 20, a second trapezoidal seat member 40, a pair of rail rods 30 and a cutting tool 50.

The rectangular base 10 has a threaded axle hole 11 at the center of one end, a square scale 12 abutting a positioning plate slidably fixed on the surface of the base 10 adjacent the axle hole 11 and perpendicular to the longitudinal direction of the base 10, an arcuate rail 13 perpendicularly secured to the other end of the base 10. The arcuate rail 13 has a slot 131 centrally extended along the length and graduate 132 extended abutting the slot 131.

The first trapezoidal seat 20 has an axle hole 21 centrally formed through the bottom and made in registry with the axle hole 11, and a pair of transverse recesses 22 at the upper corners for securing one end of the pair of rail rods 30. The seat 20 is pivoted to the axle hole 11 by a threaded pin 23.

The second trapezoidal seat member 40 has also an axle hole 41 centrally formed on the bottom thereof and made in registry with the slot 131 of the arcuate rail 13, a pair of transverse recesses 42 at the upper corners for securing the other end of the pair of rail rods 30 and a T-shaped pin 43 inserted into the axle hole 41 and through the slot 131. So that the second trapezoidal seat member 40 can laterally slide about the slot 131 and relied upon the axle hole 11 which serves as a fulcrum of the rail rods 30.

Figure 4:
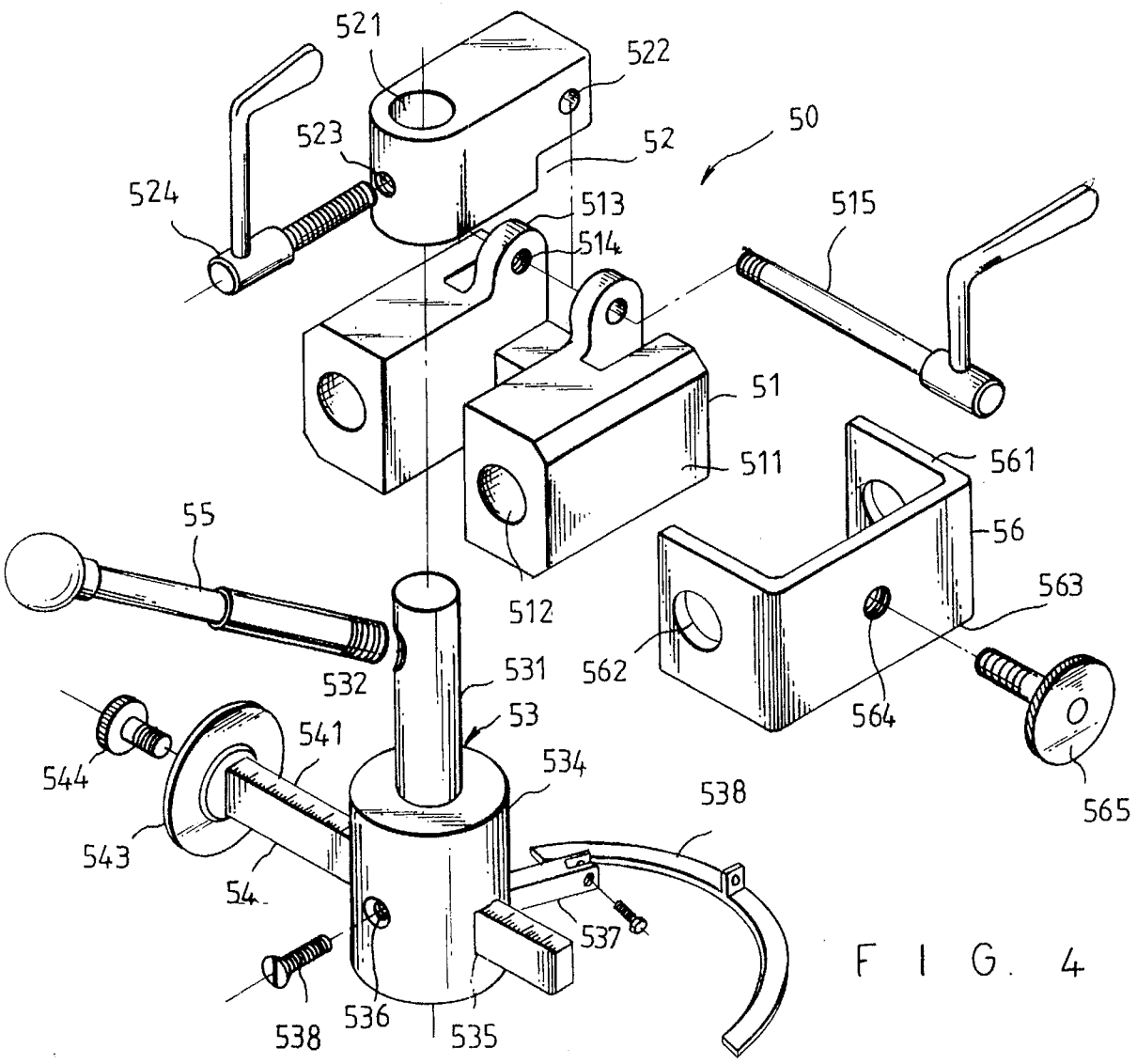
FIGS. 4 and 4A are the perspective views to show a cutting tool according to the present invention.
Figure 4A:
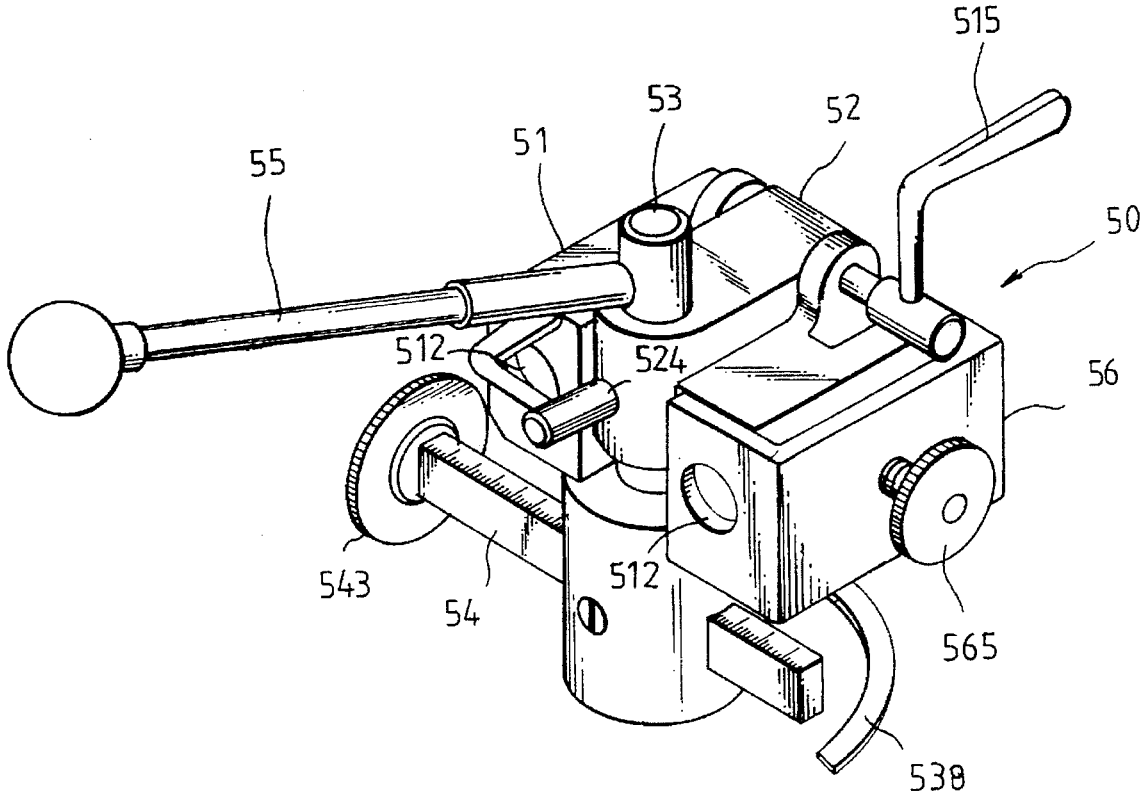

Referring to FIGS. 4 and 4A, the cutting tool 50 comprises a roughly U-shaped seat 51, a lever member 52, a cylinder shaft 53, a blade support 54 and a U-shaped locking member 56.

The U-shaped seat has a pair of lateral portions 511, each having a through hole 512 extended along the axis for sleeving on and sliding about the axis of the rail rods 30 and a lug 513 projected upward from near the rear end thereof and a transverse axle hole 514 through the center of the lug 513, one of these axle holes is threaded.

The lever member 52 has a roughly L-shaped section a vertical axle hole 521 through the center of a large portion, a transverse hole 522 through the center of a small portion made in registry with the hole 514 for pivoting the lever member 52 into the lugs 513 and secured by an axle pin 515, and a threaded through hole 523 transversely extended through the forward end of the lever member 52 in communication with hole 521.

The cylinder shaft 53 has a less diameter upper portion 531 made in registry with the vertical axle hole 521 so as to permit the cylinder shaft 53 inserting through the hole 521 and locked up by a first threaded locking pin 524, a retaining hole 532 formed on a peripheral wall of the upper portion 531 adjacent the upper end thereof for securing a handle 55 therein, a large diameter portion 534 which has a transverse rectangular hole 535 extended through the body and perpendicular to the handle 55, a threaded through hole 536 formed on a periphery perpendicular to the hole 535 and in communication therewith, and an extension 537 extended from a periphery having a holder at free end for pivotally suspending from a presser 538 thereon. The presser 538 which has a semi-circular body is provided to press the surface of a tile to keep a dynamic balancement when trims a circle.

A blade support 54 which has an elongate rectangular body including a scale 541 on the upper surface is made in registry with the rectangular hole 535 so as to permit itself sliding above the hole 535 therein and is locked up by a second threaded locking pin 539 and a thread retaining hole formed at one end thereof for pivotally securing a circular blade 543 therein by means of a screw 544. Since the blade support 54 is slidable in the rectangular hole 535, when trims a circle in a tile, the lower center of the cylinder shaft 53 would be a center of the circle to trim and the support 54 would be a radius which is lengthily adjustable in order to trim different size of circles in a tile.

A U-shaped locking member 56 has a central hole 562 transversely formed through each of the lateral portions 561 which has a diameter equal to that of the rail rods 30, a threaded central hole 564 through a transverse portion 563 thereof and a locking pin 565 has a threaded shank made in registry with the threaded central hole 564. The locking member 56 sleeves on one of the rail rods 30 and encloses one of the lateral portions 511 of the U-shaped seat 51, and fastened by the locking pin 565 which is normally keeping it's shank away from the outward surface of the lateral portion 511 so as to permit the locking member 56 sliding together with the U-shaped seat 51, when trims a circle in a tile, the locking pin 565 is further fastened to check the U-shaped seat 51 from sliding on the rail rods 30 under a certain tension force. The assembly of the cutting tool 50 is shown in FIG. 4A.

Figure 5:
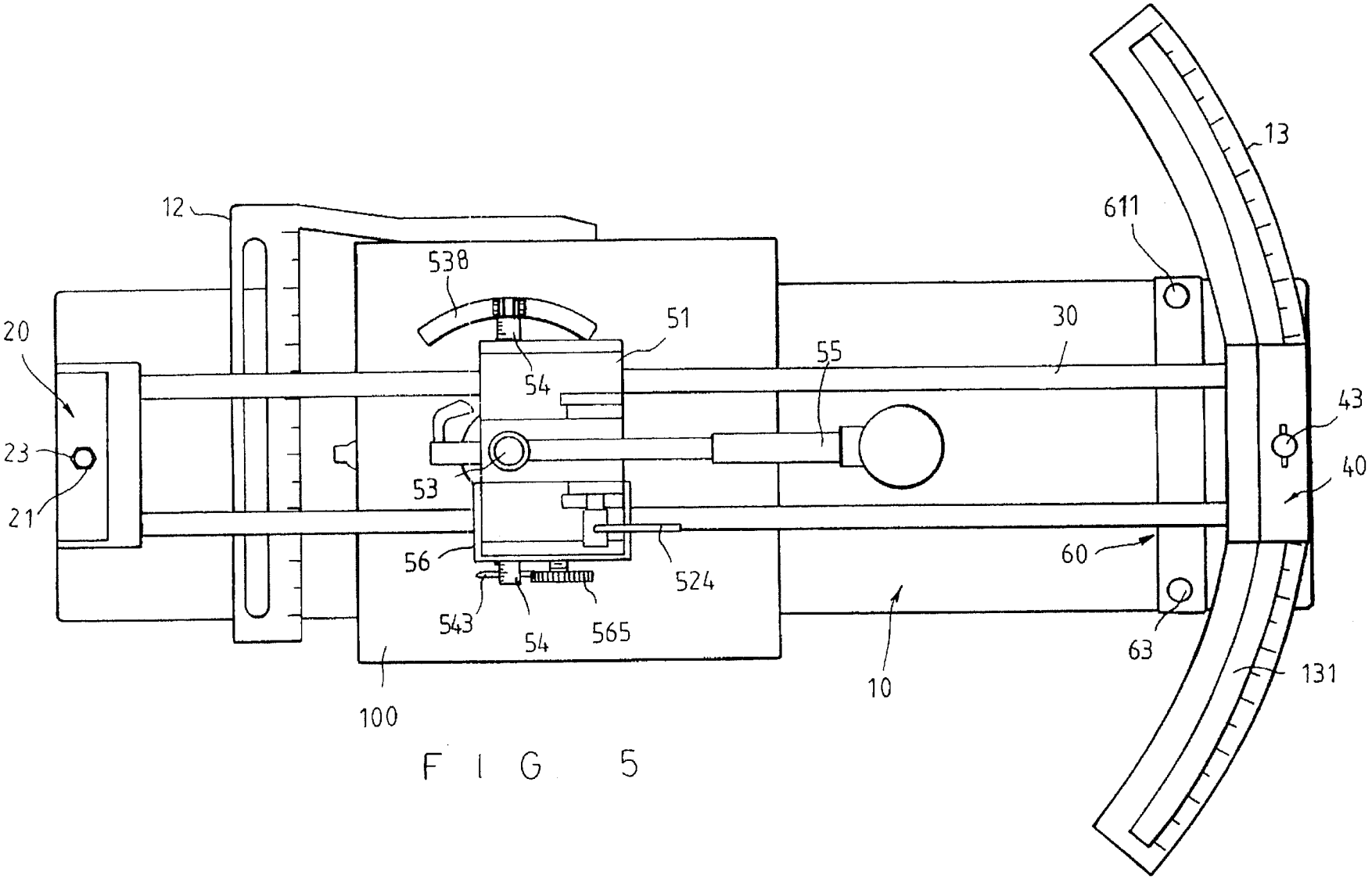
FIG. 5 is a perspective view to show a first operation mode according to the present invention.
Figure 6:
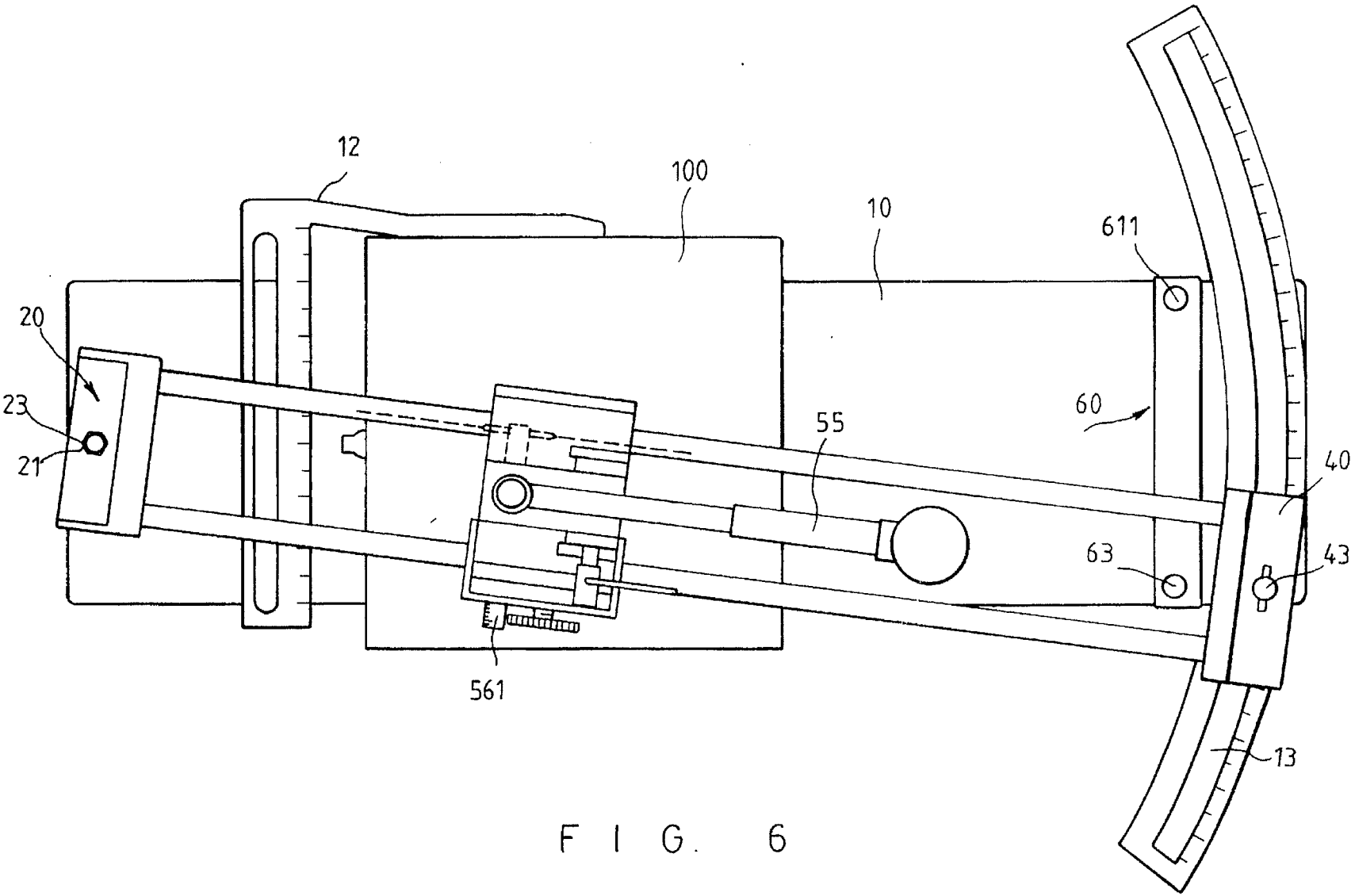
FIG. 6 is a perspective view to show a second operation mode according to the present invention.
Figure 7:
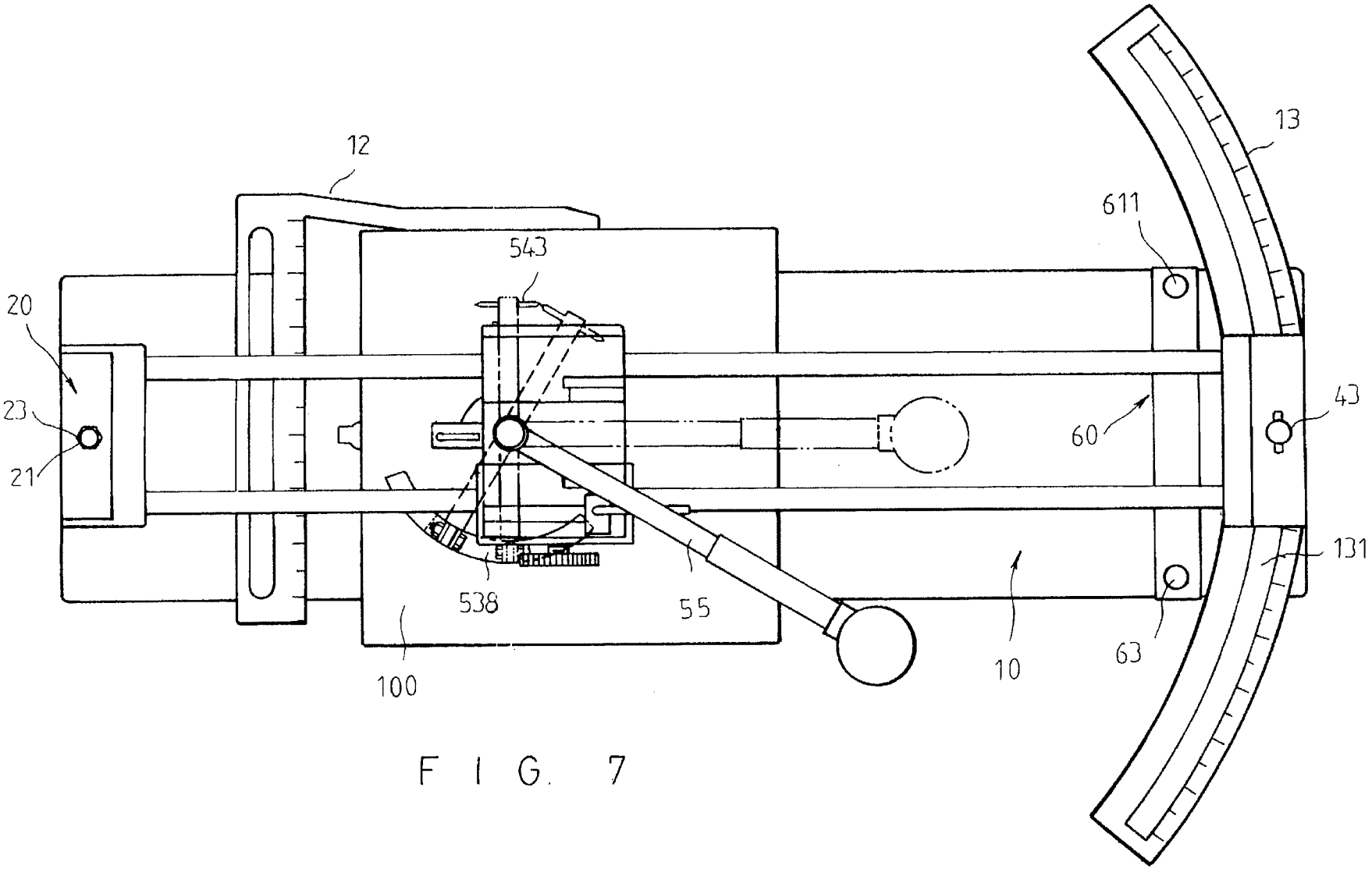
FIG. 7 is a perspective view to show a third operation mode of the present invention.
Figure 8:
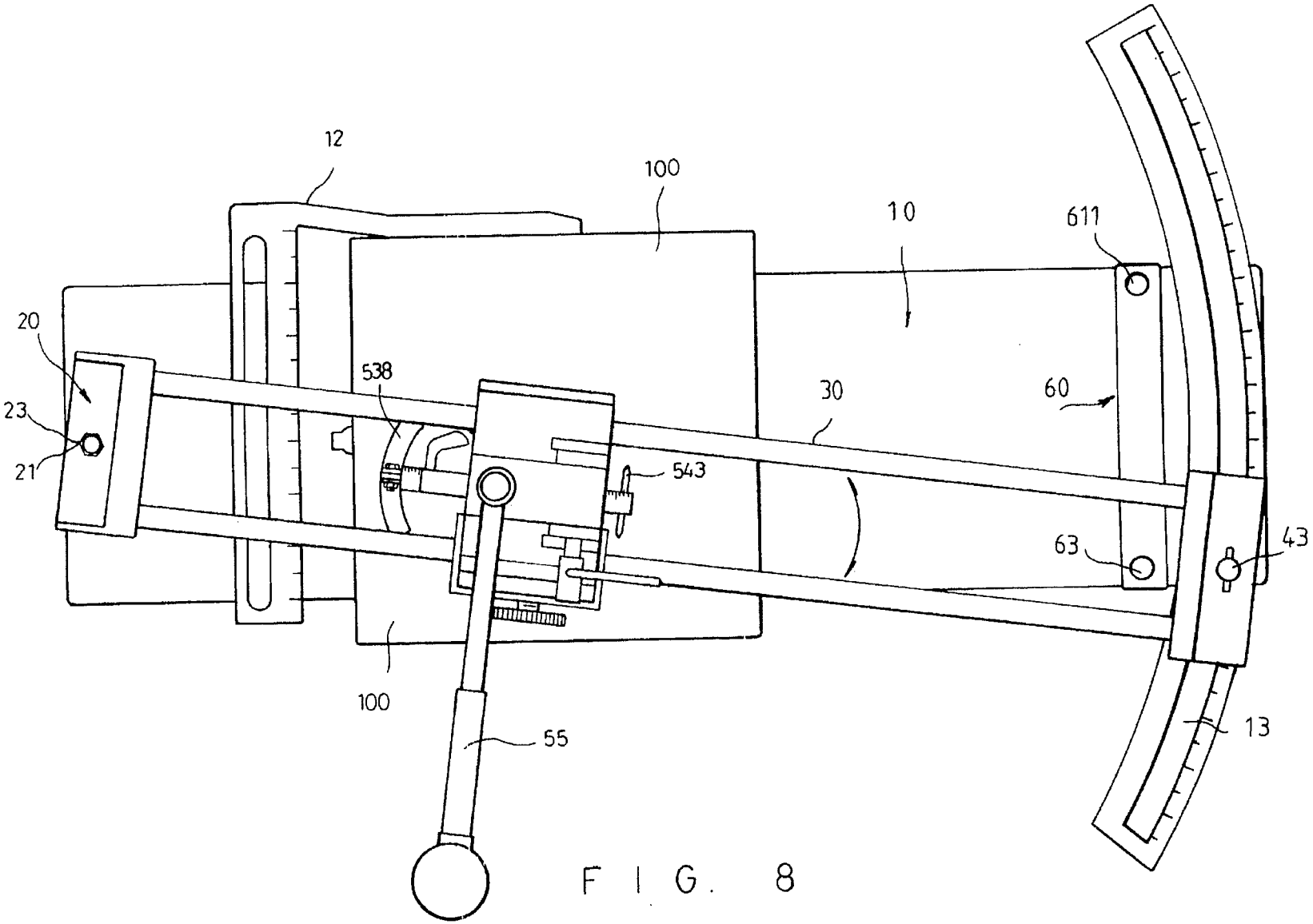
FIG. 8 is a perspective view to show a fourth operation mode according to the present invention.

Referring to FIGS. 5 to 8, there are several operation modes provide to apply the cutter of the present invention. FIG. 5 shows a first operation mode which is adaptable to trim a straight line in a tile. First of all is put a tile 100 to be trimmed on the base 10 and elaborates it into a correction orientation in accordance with the square scale 12. To assure that the rail rods 30 are exactly parallel to the lateral sides of the base 10 and afixes it by fastening the T-shaped pin 43, and then makes sure that the handle 55 is parallel to the rail rods 30 and fixes the cutting tool 50 by fastening the first threaded locking pin 524. Finally applies the handle 55 with proper pressure and slides the cutting tool 50 about the rail rods 30. So that a straight line is precisely trimmed in the tile 100. FIG. 6 shows a second operation mode which is adaptable to trim an angled straight line in a tile 100. In this mode, the most instances performed in the above mode are similar, except that slides the second trapezoidal seat member 40 about the slot 131 of the arcuate rail 13 to find out a wanted angle on the graduate 132 and fixes the seat member 40 there by the T-shaped pin 43, and then operated the handle 55 to trim a beveled straight ling in the tile 100. FIG. 7 shows a third operation mode which trims a regular circle in a tile 100. In this mode, there are more steps to be performed. First of all slides the second trapezoidal seat 40 about the slot 131 to pinpoint a center of a circle to trim by projecting the bottom center of the cylinder shaft 53 onto the tile 100 and fixes the seat 40, moves the blade support 54 horizontally to decide a certain radius of circle and fixes the support 54, and fixes the lever member 52 by further fastening the axle pin 515 and checks the cutting tool 50 from longitudinal sliding by fastening the locking pin 565, and unfastens the cylinder shaft 53 where shortens the handle 55 to rotate the cylinder shaft 53 for 360 degrees for trimming a perfect circle in the tile 100. Because of that the presser 538 on the opposite side of the blade 543 provides proper dynamic balancement, the trimming of the circle will be worked more smooth. FIG. 8 shows a fourth operation mode which trims a curve in a tile 100. It is to fix every movable parts at first in the cutting tool 50 as recited in the above mode and adjusts the length of the blade support 54 to decide the curvature of a curve to trim and then releases the T-shaped pin 43 permitting the second trapezoidal seat 40 to slide about the arcuate rail 13 where trimming a curve in the tile 100. In this mode, the blade support 54 can be toward any direction around the cutting tool 50 in order to trim the curves of different curvature. But it is normally parallel to the rail rods 30 in order the curve is centered on the axle pin 23.

Figure 1:
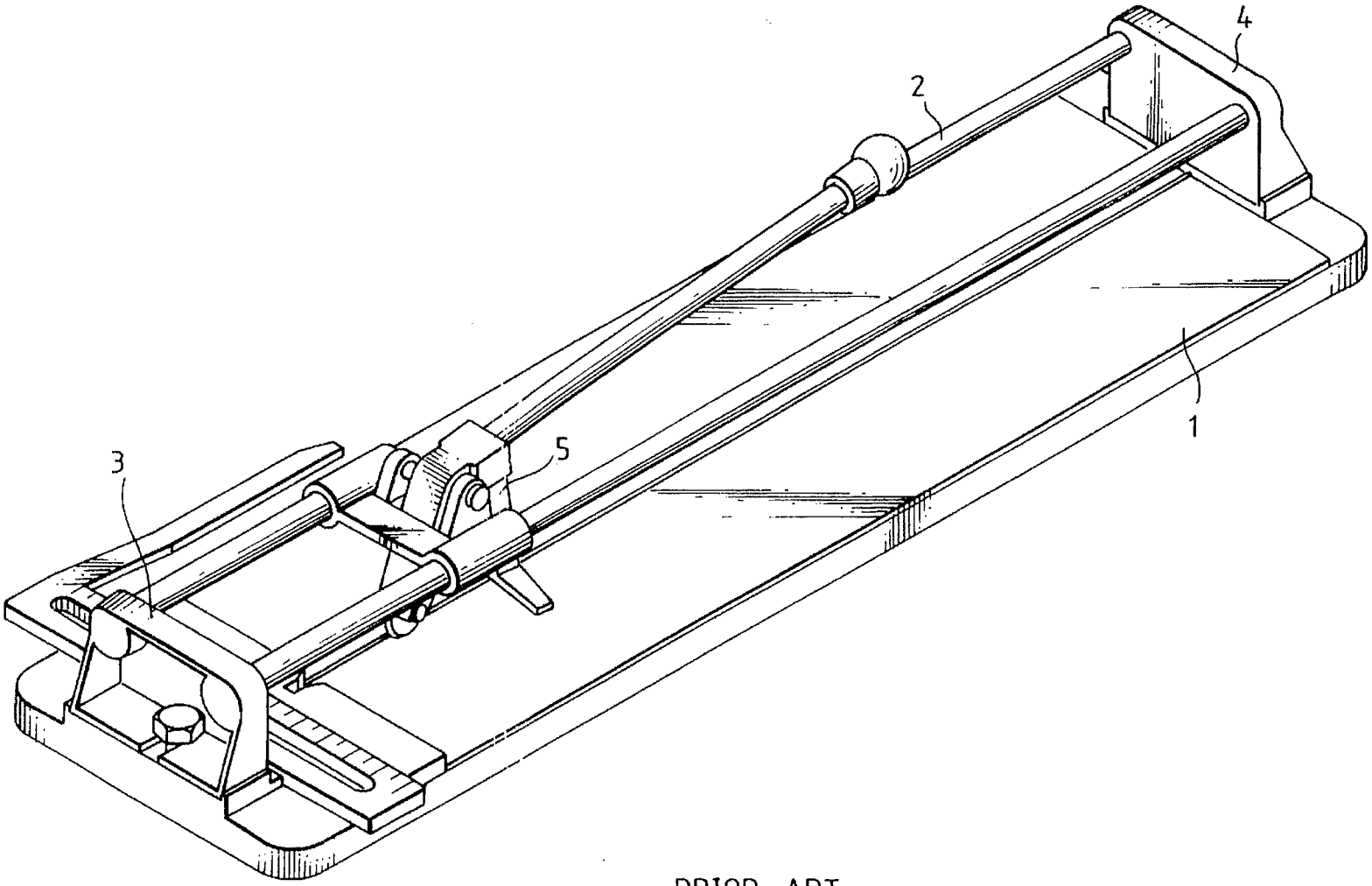
PRIOR ART FIG. 1
FIG. 1 is a perspective view to show a tile cutter of a prior art.
Figure 2:
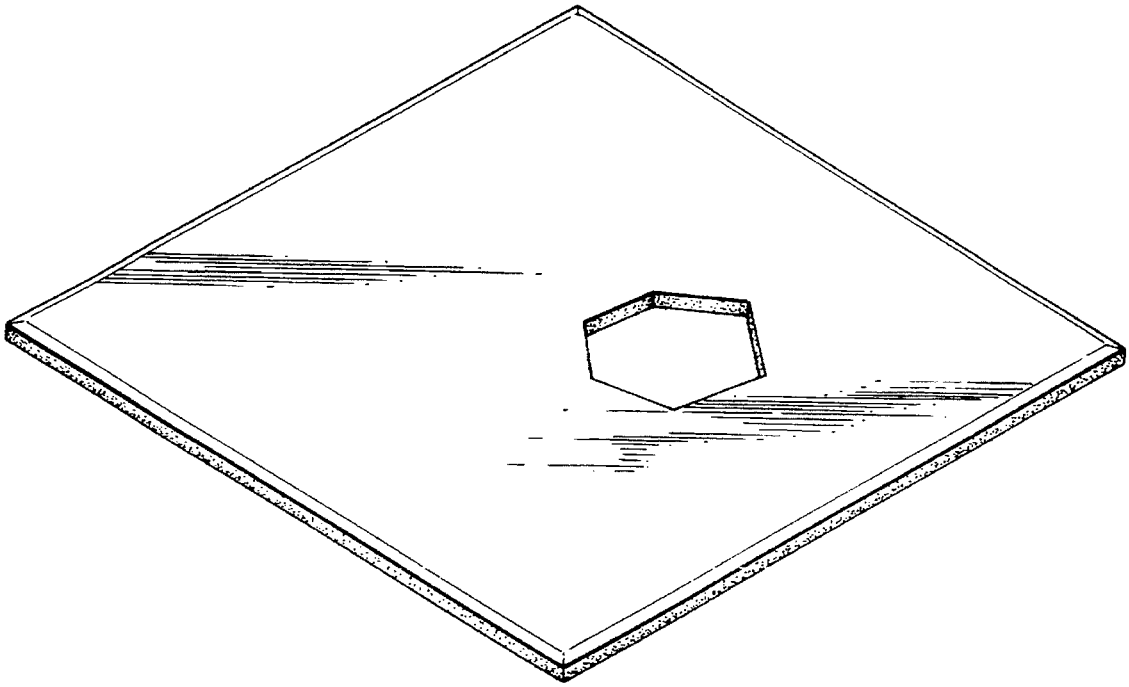
PRIOR ART FIG. 2
FIG. 2 is a perspective view to show a trimmed tile by the cutter of the prior art.
Figure 9:
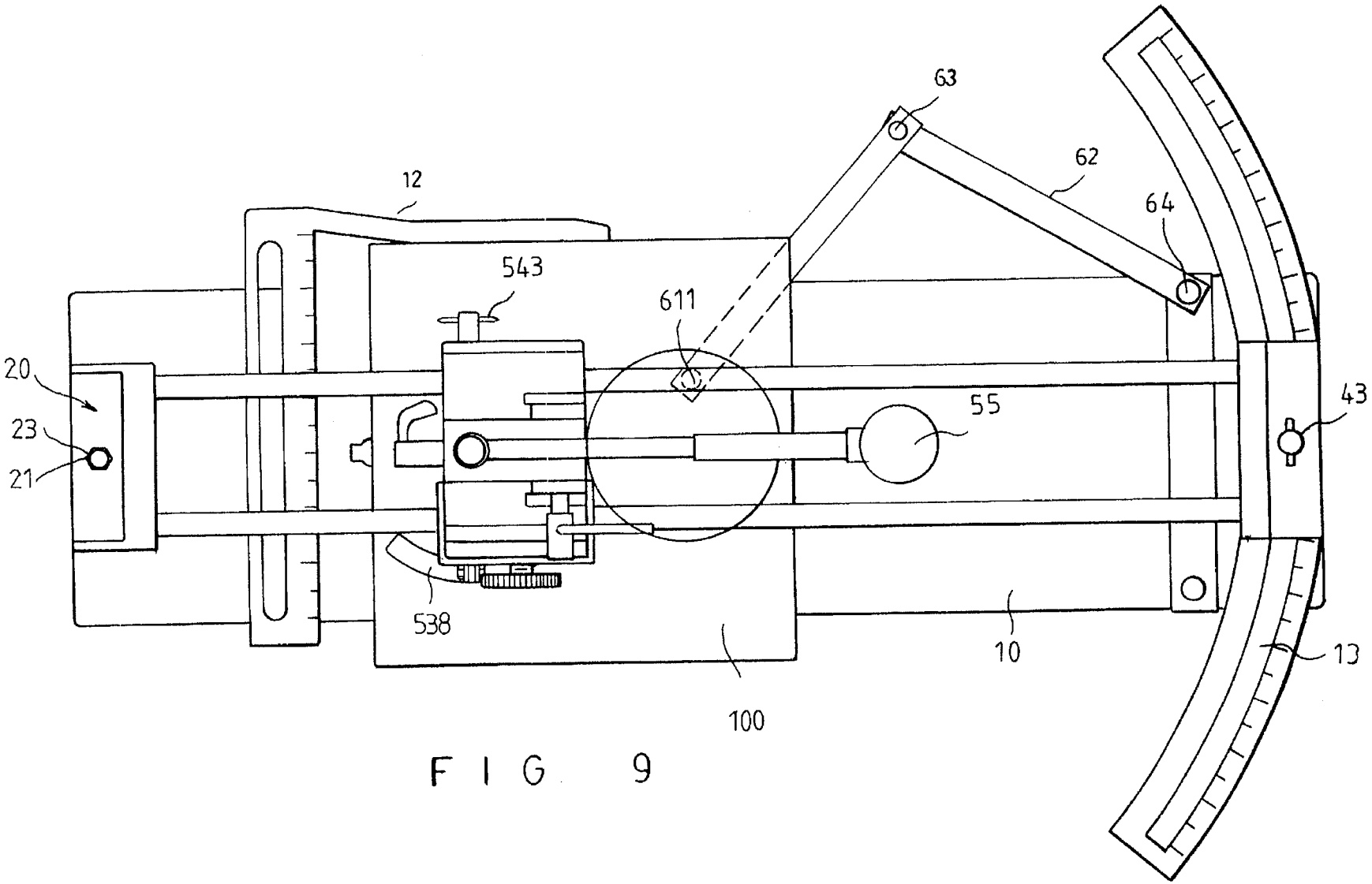
FIG. 9 is a perspective view to show a collapsible support to prop up a tile after a circle trimmed therein.
Figure 10:
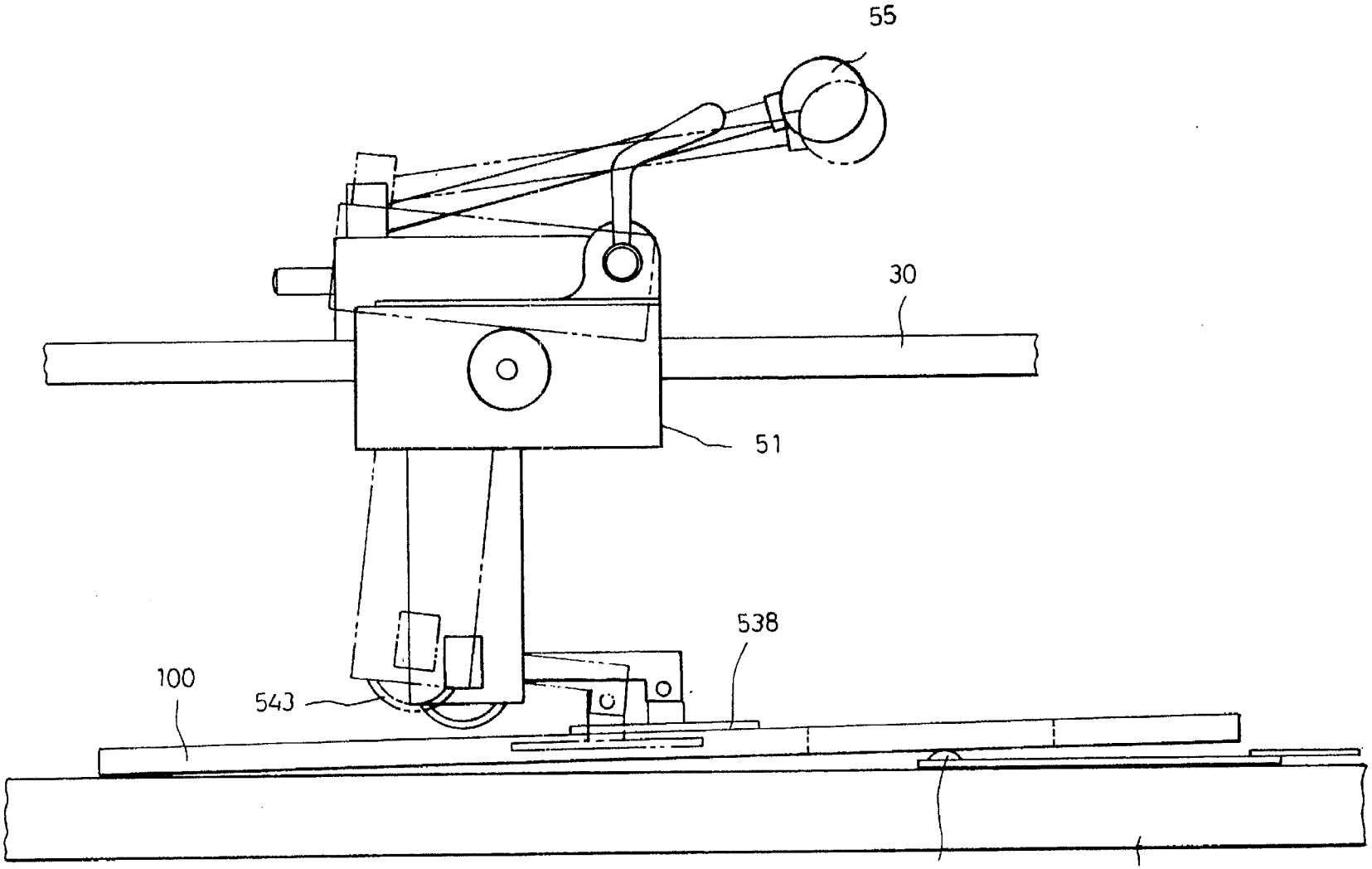
FIG. 10 is a elevational view to show a presser pressed on the surface of a tile of FIG. 9 to break open the trimmed circle from the tile.

Referring to FIGS. 9 and 10, which illustrate the application of a collapsible sustainer 60 and the presser 538 to the tile 100 after a circle therein is trimmed. The collapsible sustainer 60 is composed of a first and second rectangular plates 61 and 62 pivotally connected at their corresponding ends by a first axle pin 63 where the ether end of the second rectangular plate 62 is pivoted on a surface of the base 10 by a second axle pin 64. A dome 611 is projected upward from the other end of the first rectangular plate 61. The sustainer 60 is normally folded on the surface of the base 10 adjacent the arcuate rail 13 (as shown in FIG. 1).

When the tile 100 is trimmed, displays the sustainer 60 and puts the dome 611 at the end of the first rectangular plate 61 under the tile 100 (as shown in FIG. 9) and places the presser 538 to an appropriate position on the tile 100, then presses the handle 55 downward so that the circle is broken off along the trimmed line (as shown in FIG. 10). It is understood that the tile is a pottery having glazed upper surface, once the glaze is cutted off, the pottery is breakable. Substantially, the above instance is applicable to break up any trimmed lines in a tile 100.

Note that the specification relating to the above embodiment should be construed as exemplary rather than as limitative of the present invention, with many variations and modifications being readily attainable by a person of average skill in the art without departing from the spirit or scope thereof as defined from the appended claims and their legal equivalents.

I claim:

1. A cutter for trimming a tile comprising:

a flat rectangular base, said base having a threaded axle hole at a center of one end thereof, a square scale abutting a positioning plate transversely and slidably secured on said base adjacent the threaded axle hole, an arcuate rail secured to the other end perpendicular to the axis of said base and a collapsible sustainer foldably secured on said base and abutting said arcuate rail;

a first trapezoidal seat pivotally secured to the threaded axle hole at one end of said base and fastened by a threaded pin, said first trapezoidal seat having an axle hole centrally formed on a bottom made in registry with said threaded axle hole of said base and a pair of transverse recesses respectively formed at the upper corners;

a second trapezoidal seat slidingly secured to said arcuate rail at the other end of said base by a T-shaped pin, said second trapezoidal seat having an axle hole centrally formed at a bottom and a pair of transverse recesses respective formed at the upper corners and made in registry with the pair of recesses of said first trapezoidal seat;

a pair of rail rods of elongate cylinder body secured at their two end into the transverse recesses of said first and second trapezoidal seats and positioned parallel to the axis of said base thereabove;

a cutting tool sliding on said rail rods thereabout and along the axis thereof;

whereby said rail rods can laterally slide about said arcuate rail on the thread axle hole of said base and said cutting tool slides on said rail rods to trim a straight line, a beveled straight line, a circle or a curve in a tile.

2. A cutter according to claim 1 wherein said arcuate rail comprises a central slot formed along the length and graduate extended on one side of said slot.

3. A cutter according to claim 1 wherein said collapsible sustainer has a first and a second rectangular plate pivoted at their corresponding ends, said first rectangular plate having a dome at the other end thereof and said second rectangular plate having at the other end pivoted to said base.

4. A cutter according to claim 1 wherein said cutting tool comprises:

a roughly U-shaped seat sliding on said rail rods thereabout, said seat having a pair of lateral portions each having a transverse bore through the center thereof and a lug including an axle hole transversely formed at the center thereof with one of the axle holes being threaded;

a roughly L-shaped lever member pivoted in the lugs of said U-shaped seat by means of an axle pin, said lever member having a vertical central bore through a large portion thereof, a threaded hole extended from the forward end of the larger portion to the vertical central bore and a transverse hole through a center of a small portion made in registry with the axle holes of the lugs;

a cylinder shaft inserted through the vertical central bore of said lever member and locked by means of a first threaded locking pin, said cylinder shaft having a less diameter upper portion including a retaining hole in a periphery adjacent the top end for securing one end of a handle therein, a large diameter lower portion having a rectangular transverse hole through the body perpendicular to said handle, a threaded through hole formed on a periphery extended parallel to said handle and communicated with the rectangular transverse hole and an extension transversely projected from a periphery thereof including a holder for pivoting a pressing means;

a rectangular blade support having graduate on upper surface, slidingly inserted through the rectangular transverse hole of the cylinder shaft and locked up by means of a second threaded locking pin, said blade support having a threaded hole in one end for pivotally securing a circular blade therein by means of a screw;

means for checking said cutting tool from sliding on said rods, slid on said rail rods and enclosed one lateral portion of said U-shaped seat, said means having a U-shaped section, a pair of through holes at a center of a pair of lateral portions of said U-shaped and a threaded through hole at center of a transverse portion of said U-shaped for fastening a threaded locking pin therein.

* * * * *